US006745919B2

(12) United States Patent
Moros et al.

(10) Patent No.: US 6,745,919 B2
(45) Date of Patent: Jun. 8, 2004

(54) CONTAINER FOR DISPENSING SPILL-RESISTANT FORMULATIONS

(75) Inventors: Daniel A. Moros, Larchmont, NY (US); Satish Asotra, Brampton (CA); Theophilus van den Heuvel, Brampton (CA)

(73) Assignee: Taro Pharmaceutical Industries Ltd., Haifa Bay (IL)

( * ) Notice: Subject to any disclaimer, the term of this patent is extended or adjusted under 35 U.S.C. 154(b) by 0 days.

(21) Appl. No.: 10/277,084

(22) Filed: Oct. 22, 2002

(65) Prior Publication Data

US 2003/0080146 A1 May 1, 2003

Related U.S. Application Data

(60) Provisional application No. 60/330,464, filed on Oct. 22, 2001.

(51) Int. Cl.[7] ..... B65D 37/00

(52) U.S. Cl. ..... 222/213; 222/212; 222/562; 222/563; 222/420

(58) Field of Search ..... 222/92, 106, 211, 222/212, 213, 563, 562, 564, 464.1, 420, 107; 73/426, 429; 141/18, 24, 114

(56) References Cited

U.S. PATENT DOCUMENTS

| | | | | | |
|---|---|---|---|---|---|
| 2,684,789 | A | * | 7/1954 | Marchant | 222/212 |
| 2,734,665 | A | * | 2/1956 | Flamm | 222/207 |
| 2,987,223 | A | * | 6/1961 | Armour | 222/207 |
| 3,090,531 | A | * | 5/1963 | Weaver et al. | 222/545 |
| 3,104,032 | A | | 9/1963 | Hansen | |
| 3,133,679 | A | * | 5/1964 | Brown | 222/205 |
| 3,383,018 | A | | 5/1968 | Grimsley | |
| 4,099,651 | A | * | 7/1978 | von Winckelmann | 222/94 |
| 4,128,189 | A | * | 12/1978 | Baxter | 222/109 |
| 4,413,753 | A | | 11/1983 | Stock | |
| 4,498,609 | A | * | 2/1985 | Stock | 222/420 |
| 4,927,058 | A | | 5/1990 | Nimmey | |
| 4,938,389 | A | * | 7/1990 | Rossi et al. | 222/189.08 |
| 5,105,993 | A | | 4/1992 | La Haye | |
| 5,137,183 | A | * | 8/1992 | Mikulec et al. | 222/192 |
| 5,263,615 | A | | 11/1993 | Anderson | |
| 5,431,314 | A | | 7/1995 | Bonnelye | |
| 5,871,128 | A | * | 2/1999 | Carroll | 222/568 |
| 6,071,523 | A | | 6/2000 | Mehta | |
| 6,076,709 | A | * | 6/2000 | Wilner | 222/212 |
| 6,102,254 | A | | 8/2000 | Ross | |
| 6,105,828 | A | | 8/2000 | Kanner | |
| D483,478 | S | | 12/2003 | Carraher | |

* cited by examiner

*Primary Examiner*—Michael Mar
*Assistant Examiner*—Frederick C Nicolas
(74) *Attorney, Agent, or Firm*—Venable LLP; Michael A. Gollin; Zayd Alathari

(57) ABSTRACT

An article of manufacture comprises a) a squeezable bottle having an outlet, b) a plug in the bottle, the plug comprising an upper surface with a protruding nipple having a neck, and a top and an orifice communicating with a smooth tubular channel sized to permit a semi-solid formulation to be squeezed out of the bottle and through the channel and orifice without dislodging the cap, the neck of the nipple having a protruding height slightly greater than the thickness of a spoon, and the neck of the nipple and the flat upper surface forming a notch which engages with the edge of a spoon, the orifice forming a sharp intersection with the top of the nipple sufficient to cut flow of the formulation cleanly when pressure ceases, and the junction of the top of the nipple with the nipple neck having a bevel, and c) a child resistant cap to cover the orifice when the formulation is not in use, the cap sealing the orifice without abrading the nipple.

23 Claims, 3 Drawing Sheets

CONTAINER FOR DISPENSING SPILL-RESISTANT FORMULATIONS

This application claims the benefit of provisional application U.S. Serial No. 60/330,464, filed Oct. 22, 2001, incorporated herein by reference.

BACKGROUND OF THE INVENTION

This invention relates to a container having a nozzle suitable for accurate and problem-free delivery of spill resistant pharmaceutical compositions onto a spoon.

While devices for dispensing a measured amount of a composition have been disclosed, for example in U.S. Pat. No. 3,104,032 issued to Hansen and U.S. Pat. No. 3,383,018 issued to Grimsley, these devices tend to be complicated and are not completely satisfactory for easy delivery and administration of a measured amount of a pharmaceutical composition.

Spill resistant and non-spill pharmaceutical compositions are described in U.S. Pat. No. 6,071,523 issued to Mehta et al., and U.S. Pat. No. 6,102,254 issued to Ross, both of which are incorporated herein by reference. The advantages of the disclosed compositions require easy administration from a squeezable container onto a spoon. With standard containers, it has been found that either too much or too little material may be dispensed, making measurement difficult. Moreover, the container may become fouled by leftover material, requiring a cleaning step to ensure that the nozzle remains hygienic and attractive.

This invention solves a previously unrecognized problem of how to match nozzle size and shape to the typical dimensions of a disposable plastic spoon permitting accurate clean measurement of spill resistant formulations.

SUMMARY OF THE INVENTION

The inventive device makes it particularly easy to measure single dosage units of a pharmaceutical agent useful for systemic treatment and convenient to administer them orally in a semi-solid composition. The device is suitable for administration to children and for self administration by aging adults, and adults with motor problems.

The invention avoids problems of liquid formulations, such as spillage. It is resistant to tampering by young children or individuals with limited mental capacity due to a childproof closure.

It has been discovered that pharmaceutical agents in semisolid form, such as a gel or paste, are much easier to administer to children than liquid and solid dosage forms and are much easier for an aging adult or a adult with motor problems to measure than a liquid and in some cases are easier to swallow than a pill or capsule. It has also been discovered that such compositions can be desirably packaged in a single dosage form or in a multi-dose device which contains or is suitable for use with spoon-like measuring and administration means.

According to the invention, a device is provided for administering a pharmaceutical agent useful for oral administration to treat an illness systemically that is semisolid in gel or suspension form in a composition containing the pharmaceutical agent and a pharmaceutically acceptable vehicle comprising a thickening agent and a liquid base compatible with the pharmaceutical agent and thickening agent in which the pharmaceutical agent is soluble.

In one embodiment of the invention, a single dose of the semisolid pharmaceutical composition is contained in a squeezable container.

In another embodiment of the invention, a device comprises a squeezable bottle with multiple doses with means for administering a single dose of the semisolid composition of the invention and resealing the container thereafter.

The invention provides a device for containing multiple doses and measuring a single dose of the semisolid composition of the invention, including a squeezable container for holding the pharmaceutical composition having an open outlet with exterior threads for attaching a cap thereto, a cap with interior threads suitable to engage the outer threads of the outlet of the squeezable container, the cap having an exterior outer shell and an inner sealing layer, and a dispensing channel formed as a plug having a nipple, a shoulder, and a channel communicating through an orifice in the nipple, the plug being fixed into the interior of the open outlet of the container, such that the nipple of the plug projects outside the open outlet of the container, and the channel projects into the open outlet of the container, the orifice in the nipple providing space for the contents of the container to flow through the channel means into a spoon in response to pressure on the container when the cap is opened, whereby contents of the squeezable container can be squeezed into the bowl-shaped end of the spoon and administered therefrom.

The inventive container can be resealed by replacing the cap onto the open outlet, so that the sealing layer at the interior of the cap provides an airtight seal of the orifice and prevents air from entering or escaping the container.

The invention provides an article of manufacture comprising: a squeezable bottle having an outlet, a plug in the outlet of the bottle, the plug comprising an upper surface with a protruding nipple having a neck and a top and an orifice communicating with a smooth tubular channel sized to permit a semi-solid formulation to be squeezed out of the bottle and through the channel and orifice without dislodging the plug, the neck of the nipple having a protruding height slightly greater than the thickness of a spoon, and the neck of the nipple and the flat upper surface forming a notch which engages with the edge of a spoon, the orifice forming a sharp intersection with the top of the nipple sufficient to cut flow of the formulation cleanly when pressure ceases, and the junction of the top of the nipple with the nipple neck having a bevel, the top of the nipple being flat and wide enough to form a seal with a child resistant cap having a flat inner seal, and without being abraded by the inner seal, and a child resistant cap covering the orifice when the formulation is not in use, the cap sealing the orifice without abrading the nipple, and without being abraded by the top of the nipple.

In particular embodiments, the nipple is centered, the cap covers the orifice without protruding into it, the cap screws onto the squeezable bottle, and the plug fits into the outlet of the bottle, and the bottle may be flattened in cross-section. In commercial embodiments, the bottle contains a spill resistant formulation, in amounts e.g. from 50 to 250 or 500 ml.

In embodiments of the invention the plug is from about 0.3 cm to about 1.5 cm in height and from about 0.9 cm to 3.9 cm in diameter; the nipple is about 0.1 cm to about 0.5 cm in height and about 0.4 cm to about 1.8 cm in width; the neck is from about 0.1 cm to about 0.4 cm in diameter; the orifice is from about 0.1 to about 1.0 cm in diameter. The channel may be from about 0.6 to 2.6 cm in diameter. The shaft may be about 0.6 cm to about 2.6 cm in height and from about 0.1 to about 0.5 cm in diameter.

The upper surface of the nipple may be flat or sloped.

The invention provides a plug sized to fit in the outlet of a squeezable container, the plug comprising an upper surface with a protruding nipple having a neck and a top and an orifice communicating with a smooth tubular channel sized to permit a semi-solid formulation to be squeezed out of the container and through the channel and orifice without dislodging the plug, the neck of the nipple having a protruding height slightly greater than the thickness of a spoon, and the neck of the nipple and the flat upper surface forming a notch which engages with the edge of a spoon, the orifice forming a sharp intersection with the top of the nipple sufficient to cut flow of the formulation cleanly when pressure ceases, and the junction of the top of the nipple with the nipple neck having a bevel, the bevel and nipple being sized to form a seal against a child resistant cap placed on the plug, without abrading the nipple.

The invention provides a method for producing a container for a spill resistant formulation comprising forming a squeezable container, filling the container with the spill resistant formulation, inserting a plug having an orifice in a neck, the height of the neck being at least about the size of a spoon, and capping the container with an airtight, child-resistant cap.

An inventive method of using the bottle comprises removing the cap from the bottle, holding a spoon against the notch formed by the neck of the nipple and the flat upper surface of the plug, squeezing the bottle so that a spoonful of the formulation flows into the spoon, stopping squeezing when the spoon is full, removing the bottle from the spoon, orally administering the full spoon of the formulation to a subject, and capping the bottle, the nipple remaining free of residue.

An apparatus according to the invention comprises means for channeling a semisolid formulation from a squeezable container out an orifice when the container is squeezed, the channeling means perturbing the flow of the formulation sufficiently that it levels in a spoon, and means for cutting off flow of the formulation when squeezing the container stops, without drippage or residue on the channeling means.

DETAILED DESCRIPTION

Figure 4:
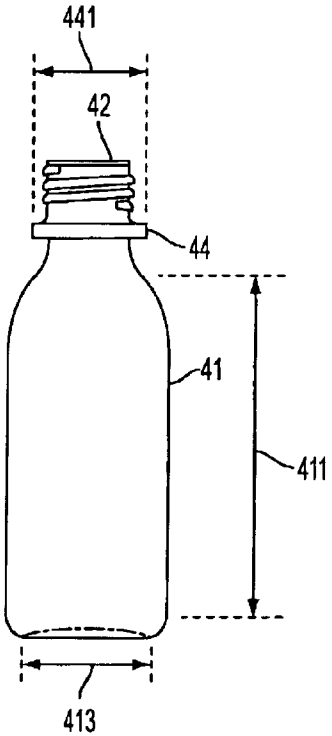
FIG. 4 illustrates a squeezable bottle, without plug, uncapped.

In describing preferred embodiments of the present invention illustrated in the drawings, specific terminology is employed for the sake of clarity. However, the invention is not intended to be limited to the specific terminology so selected. It is to be understood that each specific element includes all technical equivalents which operate in a similar manner to accomplish a similar purpose. Each reference cited here is incorporated by reference as if each were individually incorporated by reference.

Bottles of different resin types, e.g. polyethylene (PE) and low density polyethylene (LDPE), and different shapes have been tried to deliver various spill resistant pharmaceutical compositions. The squeezability of a 4-oz (113.4 grams) custom made bottle made using polyethylene terephthalate (PETG) material was satisfactory and controlled delivery of the spill resistant pharmaceutical compositions. PETG has a number average molecular weight of approximately 26,000. Other materials can be used.

Plugs of different architecture were used. The bottles without orifice reducing plugs resulted in delivery of the spill resistant pharmaceutical composition in the form of a glob. Thus, the delivery of the active ingredient will not be accurate. Plugs of various diameters have also been tried. Plugs with too narrow orifice caused great discomfort dispensing the product and there were risks of pushing the plug out of the bottle as a result of very high-pressure forces formed inside the bottle containing the spill resistant pharmaceutical compositions. Plugs with very wide orifice diameter will deliver the product in a semi-glob form and the accuracy of the dispensed dose is a major concern. Plugs of LDPE are acceptable, e.g. Huntsman PE 2030, or another polymer with similar characteristics.

The inventive device dispenses spill resistant pharmaceutical composition with ease. The plug design assures that accurate semi-solid drugs can be delivered on to a spoon with least discomfort and with controlled flow. The plug provides an unexpected advantage of an ability to cut off the flow of semi-solid products as the user wishes. The plug also avoids excess delivery in the form of a glob. The orifice-reducing plug provides a mess free dispensing system and no residue is accumulated at and around the dispensing plug after use. Additionally, this plug avoids spillage on the clothes and the carpets and floors of the room/beds etc.

The plug embodiment is particularly desirable as it facilitates the manufacturing process, which comprises manufacturing the bottle, filling with spill resistant formulation, inserting the plug, and screwing on the cap. However, the invention also contemplates any of a variety of structures, including alternatives to a screw on cap, as is known in the art, such as a pin inside the cap which rests against and closes the outlet of the squeezable container when the cap is tightened after use, or a rotatable or pivotable valve and a spring activated step valve, which allow passage of the semisolid composition from the tube to the spoon when open and seal off the contents of the squeezable container when in the closed position.

The invention is not limited to the particular dimensions shown in the figures. The device is a flattened bottle that fits in the palm of an adult hand and is easily squeezed to administer predetermined measured and accurate dose onto a bowl-shaped spoon. The bottle may be made from PETG copolyester 6763 resin, which provides clarity, toughness and flexibility. This resin provides a good flow of most of the spill resistant pharmaceutical compositions and thus helps reduce sticking of the product to walls of the bottle. The bottle may be clear or for photosensitive compositions it may be amber.

Figure 1:
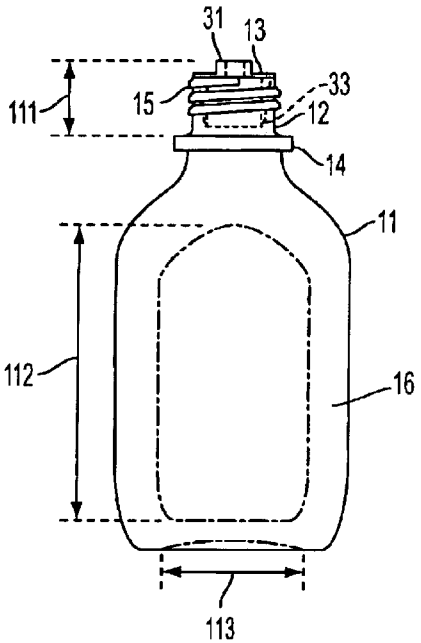
FIG. 1 illustrates a squeezable bottle, with plug, uncapped.

One exemplary embodiment of the invention is shown in FIG. 1, which illustrates an uncapped squeezable bottle with the body of the bottle 11 having a label area 16 for containing the formulation. The bottle has an open outlet 12, plug 13 inserted in the outlet, ledge 14 on which the cap may seat, and exterior threads 15. Exemplary dimensions may include a height 111 from ledge 14 to the top of plug 13 from about 0.345 to about 1.380 inches (0.876 to 3.505 cm). Preferably, height 111 is from about 0.680 in. to about 0.700 inches (about 1.727 to 1.778 cm) or about 0.690 inches (1.752 cm). Exemplary dimensions for the label area 16 may include a height 112 from about 1.410 to about 5.638 inches (3.581 to 14.320 cm), from about 2.809 to about 2.829 inches (2.134 to 7.186 cm) or about 2.819 inches (7.160 cm) and a width 113 from about 0.688 to about 2.752 inches (1.747 to 6.990 cm), from about 1.366 to about 1.386 inches (3.469 to 3.520 cm) or about 1.376 inches (3.495 cm).

In the example shown in the figures, the interior of the open outlet 12 of the bottle has a diameter of from about 0.652 inches to about 0.662 inches (1.656 to 1.681 cm) and is smooth to allow shaft 33 of plug 13 to fit inside the bottle outlet 12. The height of the outlet is about 0.690 inches (1.753 cm). The open outlet also contains exterior threads 15 for attaching the cap 22 thereto (FIG. 2) and the cap 22 has interior threads 212 suitable to engage the exterior outer threads of the outlet.

FIG. 4 shows a side view of an uncapped squeezable bottle without a plug, having a front of the bottle 41, open neck 42, and ledge 44. Ledge 44 may have a width 441 from about 0.550 to about 2.200 (1.397 to 5.588 cm), from about 1.080 to about 1.120 inches (2.743 to 2.845 cm) or about 1.100 inches (2.794 cm). The bottle may have a height 411 from about 1.817 to about 7.268 (4.615 to 18.461 cm) or about 3.634 inches (9.230 cm). The bottle width 413 may be about 0.740 to about 2.960 inches (1.879 to 7.518 cm) or from about 1.420 to about 1.540 inches (3.606 to 3.912 cm) or about 1.480 inches (3.759 cm).

Figure 2:
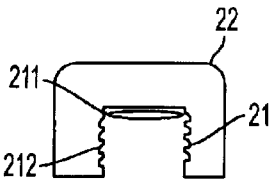
FIG. 2 illustrates a replaceable cap of the invention for the bottle.

The bottle fits into a recloseable cap, preferably childproof, an example of which is shown in FIG. 2. FIG. 2 illustrates a cap of the invention for the bottle with interior 21 and exterior 22 portions. The exterior outer shell 22 is made of durable material. Interior space 21 has a pusher lining 211 to prevent spillage or leaking. The interior 21 is taller than the combined height of open outlet 12 and projecting nipple 31 to provide space between the nipple 31 and the top of the interior of the cap when the cap is placed on to the bottle. The dimensions are such that when the cap is screwed down to the ledge, the lining abuts the top of the nipple and seals the orifice.

In one embodiment the CR cap may have the following specifications:

Description: 22/414-White HDPE Clic-Loc III Cap, lined with F-422 Tri-Seal Liner;

Outer Shell Resin: Chevron High Density HiD 9018;

Outer Shell Colorant: MA HannaColor PMS#ZB-091900NMBE;

Inner Shell Resin: Marlex HLN-120-01 Polypropylene;

Glue: Hot Melt Adhesive-Findley Adhesives; and

Liner: Tri-Seal F-422-three ply co-extruded material.

The liner presses directly down on the top of the nipple to provide an airtight seal.

Figure 3:
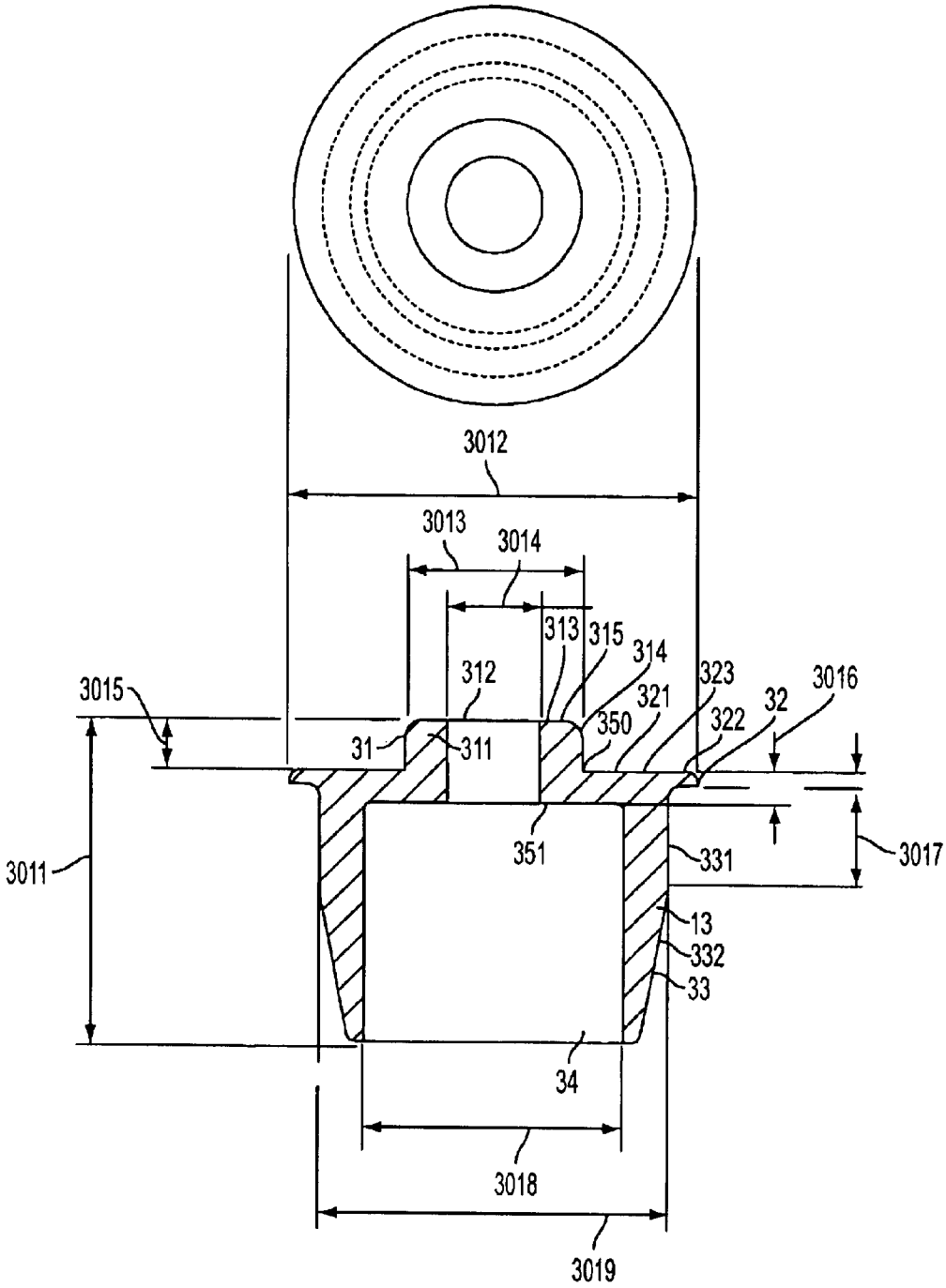
FIG. 3 shows details of construction of the plug.
Figure 5:
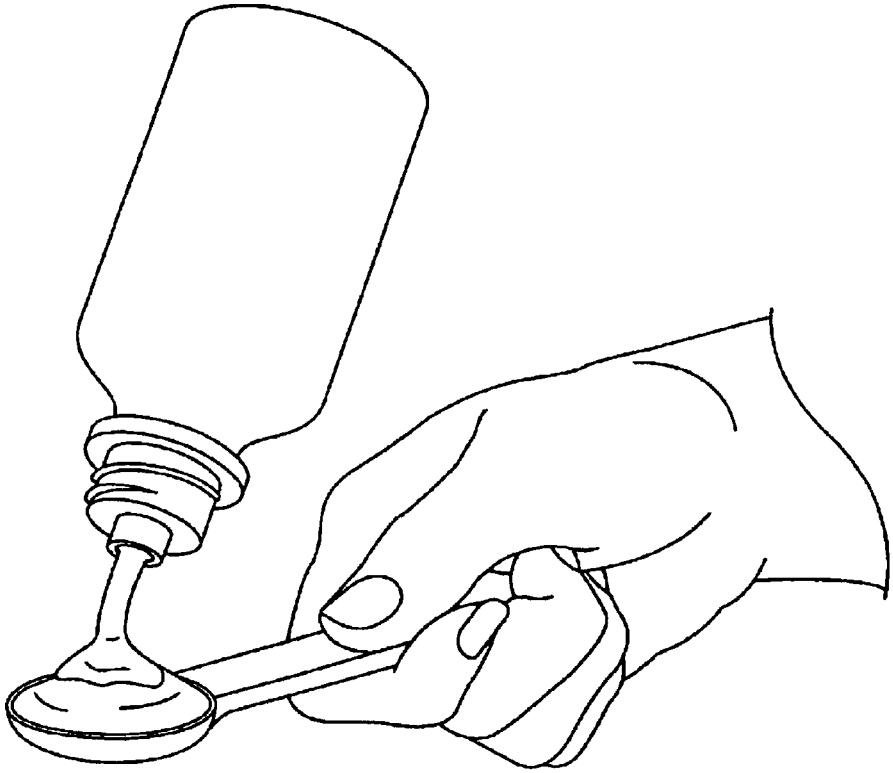
FIG. 5 illustrates the article of the invention being used with a spoon.

In an exemplary embodiment, as shown in FIG. 3, the invention may comprise plug 13, with nipple 31 having walls 311 and orifice 312. The plug has shoulder 32, shaft 33 and channel 34.

As exemplified in FIG. 3, plug 13 may be from about 0.762 cm to about 1.524 cm in height and from about 0.978 cm to 3.871 cm in diameter or from about 0.550 to about 0.650 inches (1.397 to 1.651 cm) in height and from about 0.752 to 0.772 inches (1.910 to 1.961 cm) in diameter or about 0.762 inches (1.935 cm). The nipple may be from about 0.127 cm to about 0.508 cm in height and about 0.433 cm to about 1.732 cm in width.

The nipple 31 comprises a wall 311 and an orifice 312. The orifice may be from about 0.1 to about 1.0 cm in diameter, from 0.2 to 0.5 cm, or from about 0.173 to about 0.183 inches (0.439 to 0.465 cm) in diameter, or about 0.178 inches (0.452 cm). The width of the wall 311 may be from about 0.101 to about 0.404 cm or about 0.0775 to about 0.0825 inches (0.197 to 0.210 cm), or about 0.079 inches (0.201 cm). The height of the nipple 3015 may from about 0.1 cm to about 1.0 cm, about 0.2 to about 0.5 cm, or about 0.09 to 0.11 inches (0.228 to 0.279 cm), or about 0.10 inches (0.254 cm). The overall width of the nipple may be about 0.341 inches (0.866 cm).

The plug 13 with channel is fixed into the interior of the open outlet 12, with the top 331 of the shaft having a larger diameter than the open outlet 12, so as to rest on the open outlet, and the bottom 332 of the shaft being smaller in diameter than the open outlet to allow a tight friction fit.

In the particular embodiment shown, the channel 34 may have a width of from about 0.25 to 1.0 inches (1.237 to 1.313 cm), preferably 0.487 to 0.517 inches (1.237 to 1.313 cm) in diameter. The shaft 33 may have a height of from about 0.25 to about 1.0 inches (0.635 to 2.54 cm), preferably 0.50 to about 0.520 inches (1.270 to 1.321 cm) and a top width or bottom width of from about 0.1 to 0.5 cm, or about 0.0825 to about 0.0865 inches (0.209 to 0.220 cm) in diameter. The channel 34 has a width of from about 0.04 to about 0.173 inches (0.1 to 0.44 cm), preferably from about 0.487 (1.237) to 0.517 inches (1.313 cm) in diameter. In FIG. 3 as shown, plug height 3011 measuring the bottom of the shaft to the top of the nipple is from about 0.608 to about 0.628 inches (1.544 to 1.336 cm) or about 0.618 inches (1.570 cm). The shoulder of the nipple has a height 3016 of about 0.60 inches (1.524 cm) and width 3012 from about 0.752 to about 0.772 inches (1.910 to 1.960 cm) or about 0.762 inches (1.935 cm). As shown, the height 3017 at the top of the shaft is about 0.188 inches (0.478 cm), width of the nipple 3013 is about 0.341 inches (0.866 cm), width of the orifice 3014 is from about 0.173 to about 0.183 inches (0.439 to 0.465 cm), width 3018 of the channel is about 0.497 inches (1.262 cm), and width of the top of the shaft 3019 is from about 0.652 to about 0.662 inches (1.656 to 1.68 cm).

The height of the nipple 31 is shorter than the interior of the cap 21 to keep it from contacting the top of the cap. This permits the top 315 of the nipple to remain free of debris and abrasion during closing. The nipple height is typically at least the thickness of an average spoon.

The diameter of the orifice is small enough to permit accurate and repeated dosing but large enough to allow ease of administration by manual pressure without forcing the plug out of the outlet. The wall of the nipple is thick enough to provide strength and allow easy and accurate administration by keeping the orifice in close proximity to the spoon surface. The end of the channel in the orifice and the top surface of the nipple forms a smooth sharp approximately perpendicular angle to form a sharp edge 313 that allows clean and accurate administration, and cutting off of flow, in response to manual pressure on the container. The outer edge 314 of the nipple may be beveled to improve the fit of the CR cap 22, and to avoid erosion of the nipple due to repeated capping of the product. The width of the nipple is sufficient to provide a sealing surface of adequate strength when the cap is secured. In addition, the nipple is sturdy and rigid, particularly when rested upon the spoon/bowl receptacle.

The shoulder of the plug forms a flat surface 323 that comprises a central portion 321 and an annular portion 322, which lays over the open outlet of the bottle to allow adequate fitting and sealing. The shoulder is configured to rest on the spoon during administration for stability and control. It is advantageous for the shoulder not to over hang the top of the outlet of the bottle.

On the exterior portion of the plug, the interior shoulder 321 encounters the wall 311 of the nipple 31 at a sharp corner defining a notch 350. In the interior portion of the plug, the interior shoulder 321 and the interior of the wall 311 of the nipple 31 form a sharp interior edge 351.

The orifice 312 is preferably round or nearly so as an oval shape requires higher pressure, may not improve leveling, and may admit air to the container.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

What is claimed is:

1. An article of manufacture comprising:

a. a squeezable bottle having an outlet, b. a plug in the outlet of the bottle, the plug comprising an upper surface with a protruding nipple having a neck and a top and an orifice communicating with a smooth tubular channel sized to permit a semi-solid formulation to be squeezed out of the bottle and through the channel and orifice without dislodging the plug, the neck of the nipple having a protruding height of about 0.1 cm to about 1.0 cm, and the neck of the nipple and the flat upper surface forming a notch, the orifice forming a sharp intersection with the top of the nipple sufficient to cut flow of the formulation cleanly when pressure ceases, and the junction of the top of the nipple with the nipple neck having a bevel, and c. a child resistant cap covering the orifice when the formulation is not in use, the cap having a flat inner seal and sealing the orifice without abrading the nipple, and without being abraded by the top of the nipple, the top of the nipple being flat and wide enough to form a seal with the child resistant cap, and without being abraded by the inner seal.

2. The article of claim 1, wherein the nipple is centered.

3. The article of claim 1, wherein the cap covers the orifice without protruding into said orifice.

4. The article of claim 1, wherein the cap screws onto the squeezable bottle.

5. The article of claim 1, wherein the plug fits into the outlet of the bottle.

6. The article of claim 1, wherein the bottle contains a spill resistant formulation.

7. The article of claim 1, wherein the bottle is flattened in cross-section.

8. The article according to claim 1, wherein the plug is from about 0.3 cm to about 1.5 cm in height and from about 0.9 cm to 3.9 cm in diameter.

9. The article according to claim 1, wherein the nipple is about 0.1 cm to about 0.5 cm in height and about 0.4 cm to about 1.8 cm in width.

10. The article according to claim 1, wherein the neck is from about 0.1 cm to about 0.4 cm in diameter.

11. The article of claim 1, wherein the orifice is from about 0.1 to about 1.0 cm in diameter.

12. The article according to claim 1, wherein the channel is from about 0.6 to 2.6 cm in diameter.

13. The article according to claim 1, wherein the shaft is from about 0.6 cm to about 2.6 cm in height and is from about 0.1 to about 0.5 cm in diameter.

14. The article of claim 1, wherein the bottle contains from about 50 to about 500 ml.

15. An article of claim 1, wherein the upper surface is flat.

16. An article of claim 1, wherein the upper surface is sloped.

17. A method for producing the article of manufacture of claim 1 comprising:

a. forming a squeezable container b. filling the container with the spill resistant formulation c. inserting a plug having an orifice in a neck, the height of the neck being about 0.1 cm to 1.0 cm, d. capping the container with an airtight, child-resistant cap.

18. A method of using the article of claim 1, comprising removing the cap from the bottle, squeezing the bottle so that a spoonful of the formulation flows into a spoon, stopping squeezing when the spoon is full, removing the bottle from the spoon, orally administering the full spoon of the formulation to a subject, and capping the bottle, the nipple remaining free of residue.

19. The article of claim 1, further comprising a package containing the article and a spoon.

20. The article of claim 19, wherein the spoon is a disposable plastic spoon.

21. An article of manufacture comprising: a plug sized to fit in the outlet of a squeezable container, the plug comprising an upper surface with a protruding nipple having a neck and a top and an orifice communicating with a smooth tubular channel sized to permit a semi-solid formulation to be squeezed out of the container and through the channel and orifice without dislodging the plug, the neck of the nipple having a protruding height of about 0.1 cm to 1.0 cm, and the neck of the nipple and the flat upper surface forming a notch, the orifice forming a sharp intersection with the top of the nipple sufficient to cut flow of the formulation cleanly when pressure ceases, and the junction of the top of the nipple with the nipple neck having a bevel, the bevel and nipple being sized to form a seal against a child resistant cap placed on the plug, without abrading the nipple.

22. An apparatus comprising:

a. means for channeling a semisolid formulation from a squeezable container out an orifice when the container is squeezed, the channeling means perturbing the flow of the formulation, b. means for cutting off flow of the formulation when squeezing the container stops, without drippage or residue on the channeling means, c. means for sealing the orifice without abrading the channeling means, and the sealing means not being abraded by the channeling means, wherein the channeling means comprises an upper flat surface with a protruding nipple having a neck and a top, and the orifice being in the nipple, the neck of the nipple having a protruding height of about 0.1 cm to 1.0 cm, and the neck of the nipple and the flat upper surface forming a notch, the orifice forming a sharp intersection with the top of the nipple sufficient to cut flow of the formulation cleanly when pressure ceases, and the junction of the top of the nipple with the nipple neck having a bevel, the bevel and nipple being sized to form a seal against the sealing means.

23. The apparatus of claim 22, wherein the channeling means perturbs the flow of the formulation sufficiently that it levels in a spoon.

* * * * *